US008782995B1

(12) United States Patent
Hoover et al.

(10) Patent No.: US 8,782,995 B1
(45) Date of Patent: Jul. 22, 2014

(54) COLLAPSIBLE STORAGE CONTAINER

(71) Applicant: Enviro Storage Solutions, LLC, Sewickley, PA (US)

(72) Inventors: Eric Hoover, Conneaut Lake, PA (US); Kevin Keisel, Cochranton, PA (US)

(73) Assignee: Enviro Storage Solutions, LLC, Sewickley, PA (US)

( * ) Notice: Subject to any disclaimer, the term of this patent is extended or adjusted under 35 U.S.C. 154(b) by 0 days.

(21) Appl. No.: 13/790,188

(22) Filed: Mar. 8, 2013

Related U.S. Application Data

(60) Provisional application No. 61/616,172, filed on Mar. 27, 2012.

(51) Int. Cl.
*B65D 6/16* (2006.01)

(52) U.S. Cl.
USPC ..... 52/745.01; 52/745.03; 220/1.6; 220/9.1; 220/9.2; 220/4.28; 220/4.9; 206/600

(58) Field of Classification Search
USPC ..... 52/79.1–79.13, 782.1, 785.11, 741.1, 52/745.01, 742.1, 745.02, 745.2, 746.12, 52/745.05, 79.5; 220/1.6, 1.5, 4.28, 4.29, 220/9.1, 9.2, 6, 9.3, 666; 166/308.1, 308.3; 206/600
See application file for complete search history.

(56) References Cited

U.S. PATENT DOCUMENTS

| | | | | |
|---|---|---|---|---|
| 2,437,058 | A * | 3/1948 | Waters | 220/6 |
| 2,751,635 | A * | 6/1956 | Donnahue | 52/69 |
| 3,173,579 | A * | 3/1965 | Curie et al. | 222/105 |
| 3,966,285 | A | 6/1976 | Porch et al. | |
| 4,779,514 | A * | 10/1988 | Prigmore et al. | 52/79.5 |
| 5,288,170 | A * | 2/1994 | Cummings | 405/129.95 |
| 5,493,818 | A * | 2/1996 | Wilson | 52/71 |
| 5,596,844 | A * | 1/1997 | Kalinowski | 52/79.5 |
| 5,862,931 | A | 1/1999 | Cox et al. | |
| 6,983,567 | B2 * | 1/2006 | Ciotti | 52/79.5 |
| 7,624,543 | B2 * | 12/2009 | Sample et al. | 52/79.5 |
| 8,132,307 | B2 * | 3/2012 | Aichner et al. | 29/91.1 |
| 8,166,715 | B2 * | 5/2012 | De Azambuja | 52/79.5 |
| 8,286,391 | B2 * | 10/2012 | Yang et al. | 52/69 |
| 2006/0045682 | A1 * | 3/2006 | Norris | 414/408 |
| 2009/0218342 | A1 * | 9/2009 | Pickles | 220/6 |
| 2009/0261111 | A1 * | 10/2009 | Hsu | 220/592.2 |
| 2011/0180533 | A1 * | 7/2011 | Hay et al. | 220/4.28 |
| 2012/0132650 | A1 * | 5/2012 | Buonerba et al. | 220/1.6 |
| 2013/0306322 | A1 * | 11/2013 | Sanborn et al. | 166/308.1 |

FOREIGN PATENT DOCUMENTS

CN 202593988 * 12/2012

* cited by examiner

*Primary Examiner* — Jeanette E. Chapman
(74) *Attorney, Agent, or Firm* — Buchanan Ingersoll & Rooney PC

(57) ABSTRACT

We provide a method and apparatus for creation of temporary storage solutions. These may include, for example, one or more collapsible storage containers. These containers may be moved, optionally with many containers on a single transport unit, to a site in need of storage. The containers may be assembled on-site on an as-needed basis. Following assembly and use of the containers they may be disassembled and moved, optionally by single transport unit, to a new location in need of temporary water storage. Although not limited by the type of material that is stored, typical containers may store, for example, sand, water, gravel, carbon dust, or other solid or liquid substances.

14 Claims, 11 Drawing Sheets

COLLAPSIBLE STORAGE CONTAINER

BACKGROUND OF THE INVENTION

1. Field of the Invention

Embodiments of the invention relate to the storage and transport of solids and liquids. Preferred embodiment relate to temporary storage of water and to water storage devices in the field of hydrocarbon extraction.

2. Description of the Related Art

Many industries require the use of large volumes of water, sand, or other materials. In some cases the need for storing these materials, or in fact the entire facility creating the need for storing these materials, is transitory. Although the remainder of this background will be discussed in terms of the storage of water, those of skill in the art will recognize, with the benefit of this disclosure, that similar challenges exist in many industries and for storage of many materials, including but not limited to sand, gravel, carbon dust, and concrete, or for liquids that may not be water. The claimed invention may solve one or more problems associated with storage of those and other materials.

One particular industry that may require large volumes of water is the extraction of hydrocarbons from underground deposits. For example, to obtain oil from "tar sands" one may engage in "steam assisted gravity drainage," which requires many volumes of high-quality water for each volume of oil that is obtained. Water is also important to the "hydraulic fracturing" (or "fracking") process that may be used to obtain natural gas from shale.

In many cases, the water that is used for hydrocarbon extraction is re-used multiple times, resulting in benefits both to the cost of operations and to the environment. In most situations this requires that water be stored at or convenient to the facility where extraction occurs.

Very often the quality of water after use decreases to the point that purification is required. This may be necessary for environmental reasons (for example, for responsible and compliant disposal) or for reasons related to the further use of the water (for example, as high quality steam).

When water use and purification take place at many different locations (for example, as it does in the fracking process), building and maintaining water purification facilities at all of the locations where water is used and purified can be expensive and inefficient. This is particularly the case where the water use and purification are only necessary for a short period of time, for example during the establishment of a wellhead. Having a large number of separate facilities requires transport of a potentially significant number of small amounts of material. For example, water purification that includes liquid concentration or zero liquid discharge may result in liquid or solid byproducts. There may be a need to collect and store these byproducts for further use, processing, or disposal.

One way that storage, purification, or treatment of water for a large number of sites may be accomplished is to build one or more large purification facilities in reasonable proximity to the sites of use and re-use. This allows the use of economies of scale in the production of the facilities and reduces the need for transport of waste products, which may be accumulated and disposed of together rather than gathered from multiple sites.

One substantial drawback to the use of a single large site for purification or storage is the need to transport the water to be purified to and from the sites of use and re-use. Sometimes the capacity of a facility is too low to handle a substantial influx of water and the water must be stored on-site as it awaits purification. In other cases a large amount of purified water must be stored prior to or after distribution to a site in need of water. In some situations the water is required to sit for substantial periods of time in retaining ponds.

Typically water, both before and after purification, is transported either by pipeline or by tanker truck. Pipelines are expensive to produce and can have an appreciable environmental impact. Tanker trucks are more useful, but use of a truck to store water at both the purification facility and at the use site is an inefficient use of the tanker truck resource. Transport of an empty tanker truck to provide additional storage volume is also inefficient. In some cases the water is transported by a "fixed axle tank," also known as a "frac tank," which may be placed on-site and used to store water until the completion of a project.

After the project has been completed the frac tanks or storage tanks may be hauled away, one at a time, for long-term storage or more likely to the next job. This can be inefficient because significant time and effort may be put to hauling empty tanks, one at a time, to and from job sites. In addition to the inefficiencies that are introduced, this procedure may significantly increase the truck traffic one roads associated with extraction sites, as multiple separate trucks are required to remove the frac tanks.

Frac tanks and the like have other disadvantages. For example, due to requirements that they not be overweight or over height, frac tanks have limited storage volumes. Because frac tanks are considered parts of vehicles, they require separate axles, registrations, lights, and permits that all increase the cost of use of the tanks. All of these things increase the cost and complexity of the tanks.

The frac tanks and other water storage tanks also offer substantial challenges related to cleaning the tanks. Chemicals that are used in cleaning the tanks may be caustic or acidic, and in the case of covered tanks the only effective means of cleaning might be for access by a cleaning technician.

As an alternative to frac tanks, some water storage and purification operations establish large ponds or impoundments. Creation and maintenance of these impoundments requires significant construction activity, including grading, leveling, and other ground operations. Location of a pond in-ground makes repair or drainage more difficult in the event of a leak or other failure. When water storage is no longer needed at a site, the impoundments must be filled or otherwise disposed of. More recently, many government entities have begun more stringently regulating impoundments due to their perceived risk for environmental disturbance. This has further increased the cost of installation and use of ponds and impoundments.

Although the prior discussion has focused on the challenges of storage of water, many other commonly used substances present their own storage challenges. For example, an entity may wish to use temporary storage for sand, gravel, carbon dust, or concrete, or for liquids that may not be water.

BRIEF SUMMARY OF THE INVENTION

We have found that many of the inefficiencies and expenses associated with storage of substances such as water and transport and assembly of storage facilities may be substantially reduced through the use of a collapsible, scalable storage container solution that is presented herein. Embodiments provide storage containers that may be easily shipped in a disassembled or partially disassembled state, and then reassembled on-site for storage. A disassembled container is typically unable to reliably store material in the same amount that the container stores when assembled. At the conclusion of a job or as the needs for storage change, one or more containers may be broken down, moved, stored, or otherwise used in ways not available to tanker trucks or other storage devices. In preferred embodiments, multiple disassembled or partially disassembled containers may be placed on a flatbed or other transport device, then transported in a single operation.

An embodiment of the invention provides a method for creating a temporary storage facility. This may be used, for example, to contain water. It may be placed at an energy extraction facility. The method may include the steps of providing to a site related to energy extraction, through a single transport unit, a number of storage containers. The storage containers are provided in a disassembled state that is unsuitable for storage of a material to be stored, but after they are assembled they are suitable for storage. Upon completion of their use the containers are disassembled. Of course it will be understood that embodiments of the invention accommodate use of more than a single transport unit to transport an even larger number of storage containers than a single transport unit might provide.

Following disassembly the containers may be transported to a different site in need of water storage. Because of the easily disassembled nature of the containers, many of them may be transported at once by a single transport unit, both before and after use. Useful transport units include, for example, flatbed trucks, barges, and rail cars.

Embodiments of the invention may be particularly useful in the energy extraction and related water purification industries. Containers may be assembled, for example, at water purification plants and a hydraulic fracturing drill sites. Uses for other industries and at other sites are possible.

In some embodiments the containers include liners that may be removed upon disassembly of a container. If transport is unnecessary, then the containers may be stored in a disassembled state. While assembled, multiple containers may be placed in communication with each other. This allows flow of stored material throughout the containers. Material may be added to or removed from the containers as needed.

Another embodiment provides a collapsible storage container including a bottom, two opposite side walls, and two opposite end walls. When the container is in an assembled state the opposite side walls and opposite end walls are approximately perpendicular to each other and to the bottom. Each of the opposite side walls is attached to the bottom through at least two side wall hinge pins disposed in corresponding side wall hinge plates, which may be slotted hinge plates, and each of the end walls are attached to the bottom through at least one of a slot and groove configuration and at least one end wall hinge pin disposed in a corresponding end wall hinge plate, which may be a slotted end wall hinge plate. The hinge plates and pins may be disposed either on the bottom or on the corresponding side wall or end wall.

A collapsible storage container may include optional attachments, including one or more liners that may be the same or different, a catwalk on the side wall or end wall, and/or at least one piping outlet that allows multiple containers to be placed in communication with each other. Containers may also include a lid that completely or partially covers the assembled container.

DETAILED DESCRIPTION OF THE FIGURES

DETAILED DESCRIPTION OF THE INVENTION

We provide a collapsible storage container for storage of water, sand, gravel, concrete, or other substances. Stored substances may be liquids or solids. Typically the containers are made of steel, though polymers and other metals or alloys may be used. In some embodiments of the invention one or more liners may be affixed to the container during or following assembly. Each liner may be independently selected, and may be, for example, a flexible polypropylene liner. In another embodiment a more permanent liner may be applied to the base material used for the container. This may be, for example, an epoxy liner. Use of an epoxy base liner will not foreclose the use of one or more other, more temporary liners, if desired.

Containers of the invention may be of any shape so long as they are collapsible. In preferred embodiments containers have a rectangular base and at least one set of opposing sides that is rectangular, in addition to another set of opposing sides that is square or rectangular. This shape assists with transport by truck, ship, or rail when the containers are collapsed.

Figures 1A, 1B:
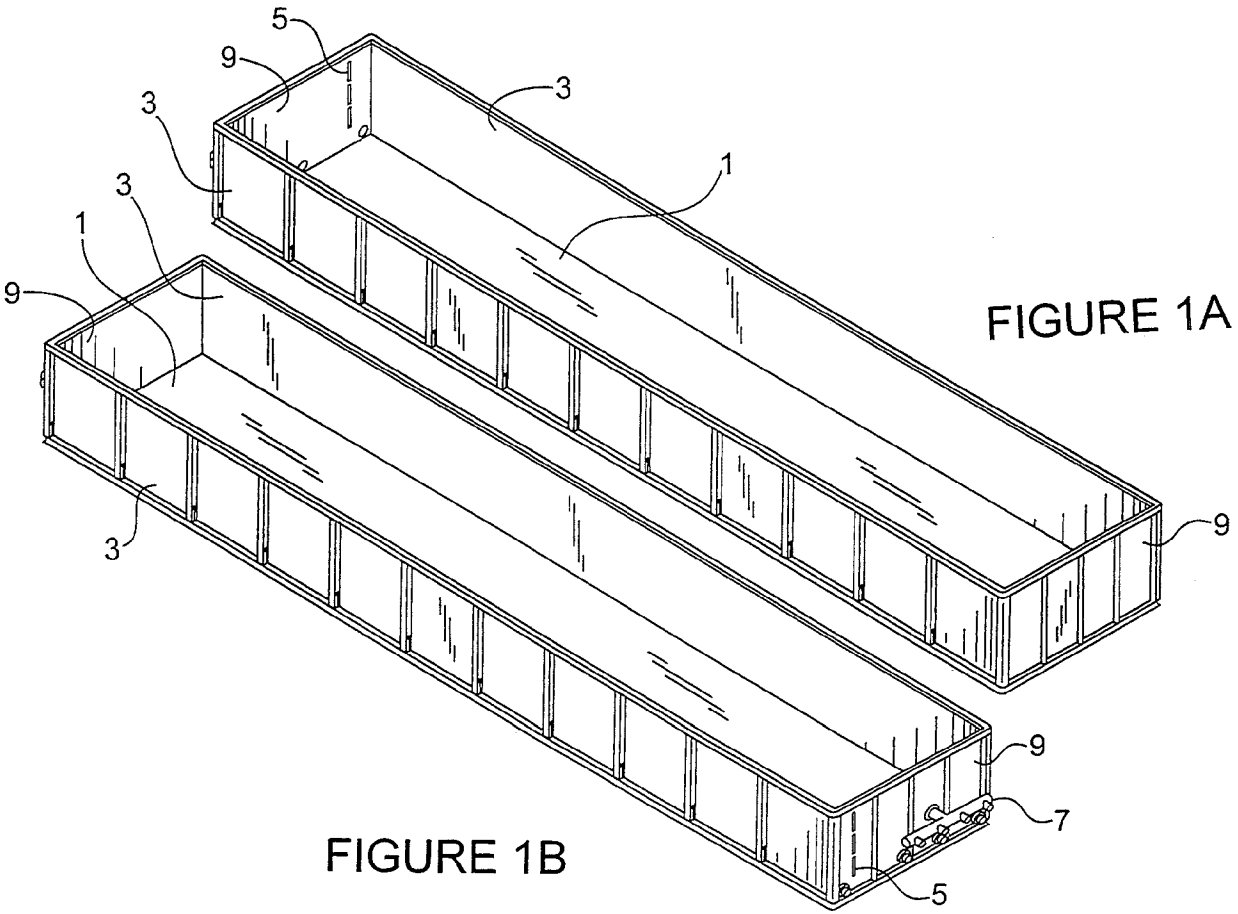
FIG. 1A is a left end perspective view of a collapsible container of an embodiment of the invention.
FIG. 1B is a right end perspective view of the collapsible container.

Embodiments of the invention may be better understood with reference to the Figures. As shown in FIG. 1, typical containers have an open top, a closed bottom (also referred to as a container base) 1, two opposite side walls 3, and two opposite end walls 9. The bottom 1 may be sloped to provide drainage to a selected end of the container. FIG. 1B also shows piping outlets and connectors 7. In a further embodiment a container may include a top or lid that covers all or part of the open top. This top or lid may include access holes, windows, or vents. When assembled the walls and bottom may be perpendicular to each other. In some embodiments they may be approximately perpendicular, which means that their angle of separation may be set between 80 and 100 degrees.

Figure 10A:
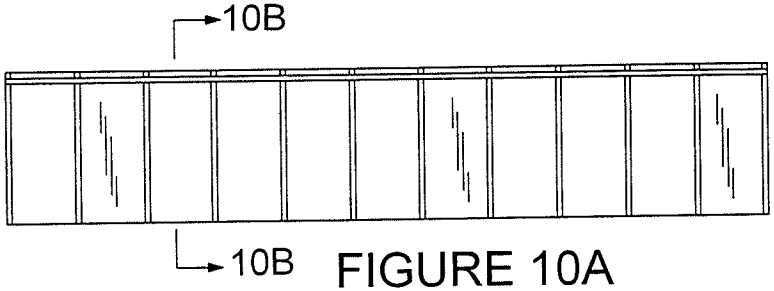
FIG. 10A is a top view of a container with the end walls removed, and the side walls fully folded.
Figure 10B:
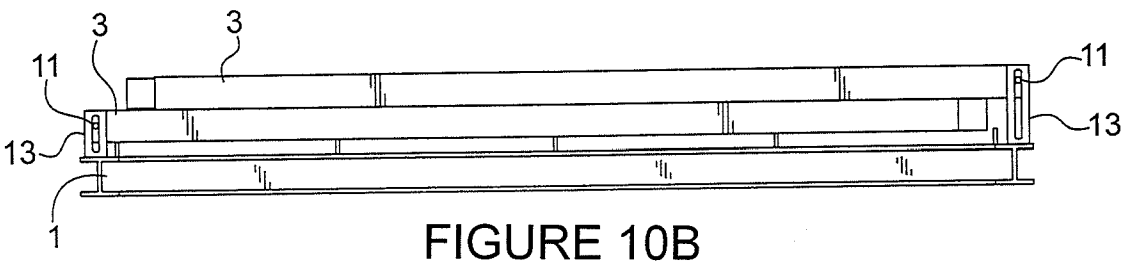
FIG. 10B is a cross-sectional view of the container taken along the section line 10B-10B in FIG. 10A.
Figure 11:
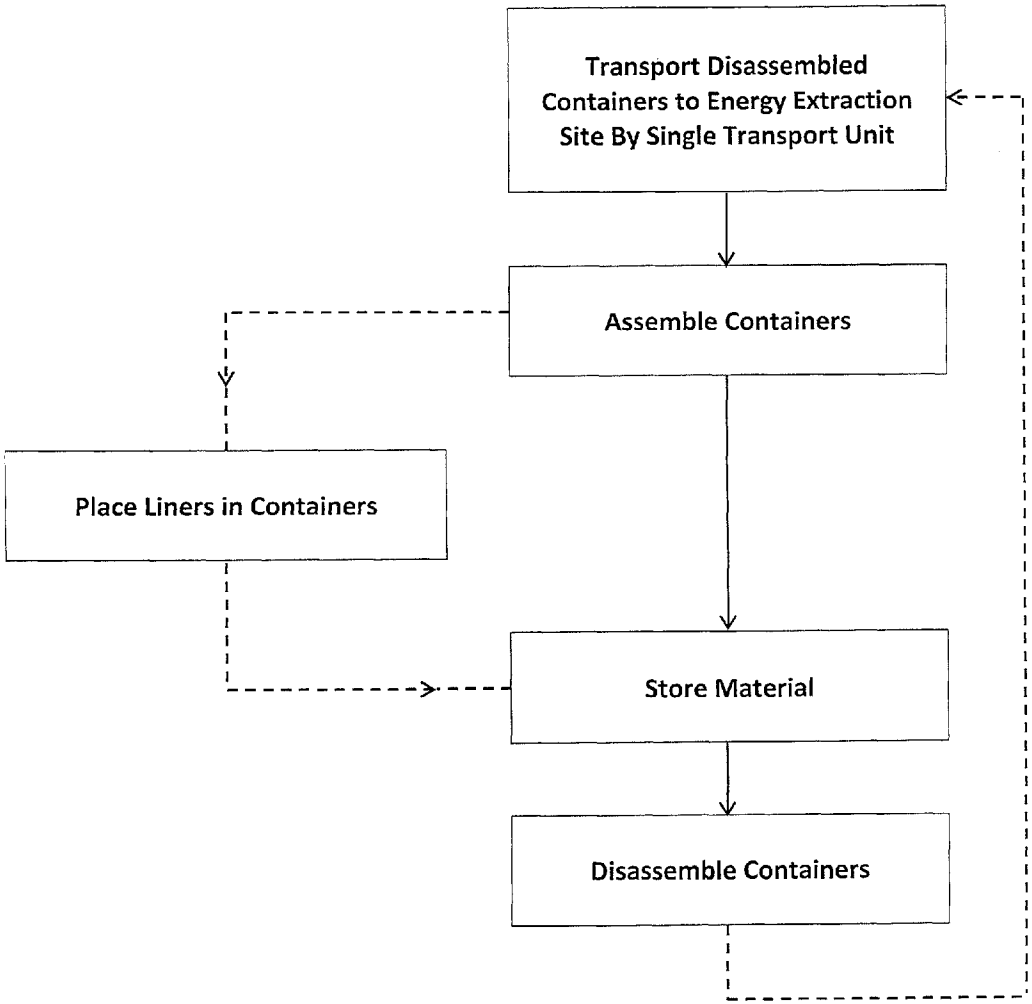
FIG. 11 shows a flowchart of a method of the invention.

The side walls are connected to the bottom by one or more joints or hinges. As shown in FIG. 10B, the hinge arrangement allows the side walls 3 to fold flat to the bottom of the container for storage and/or transport.

Figure 3A:
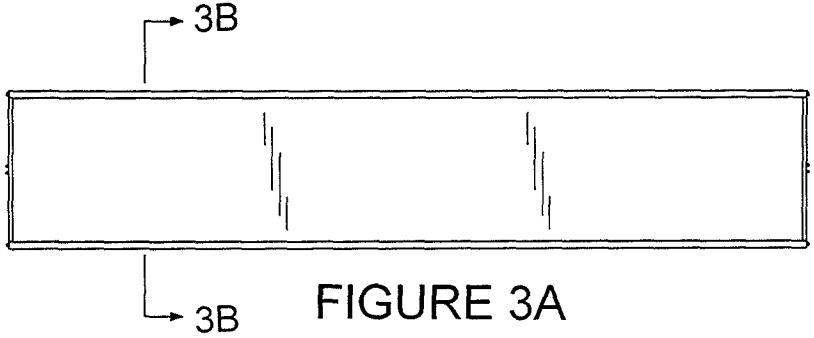
FIG. 3A is a top view of a container of the invention, with the end walls removed.
Figure 3B:
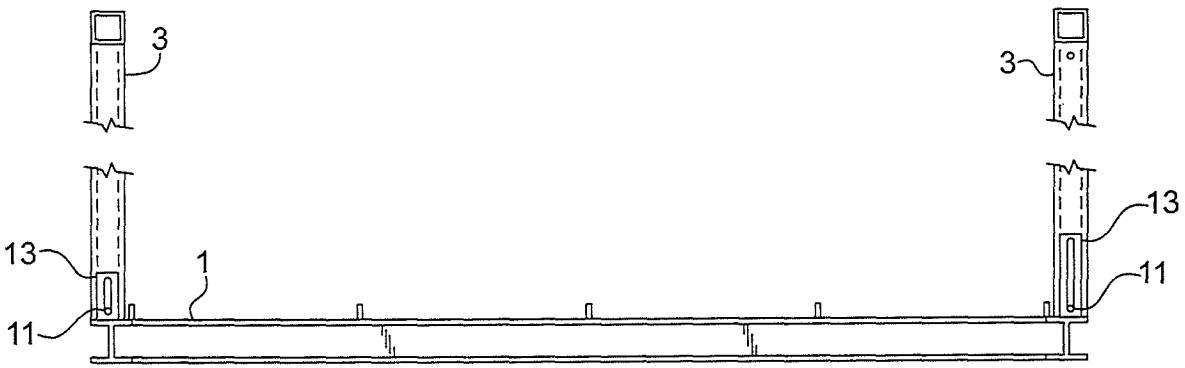
FIG. 3B is a cross-sectional view of the container taken along the section line 3B-3B in FIG. 3A.
Figure 9B:
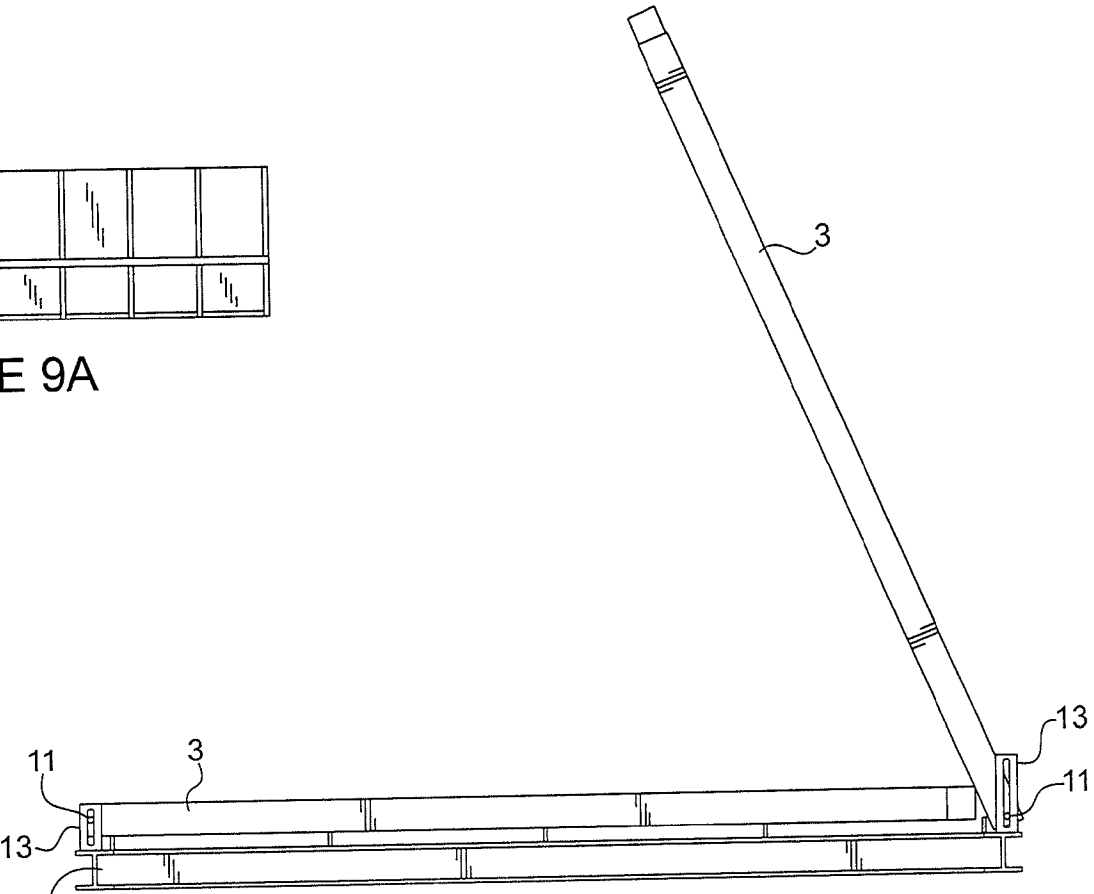
FIG. 9B is a cross-sectional view of the container taken along the section line 9B-9B in FIG. 9A.
Figure 9A:
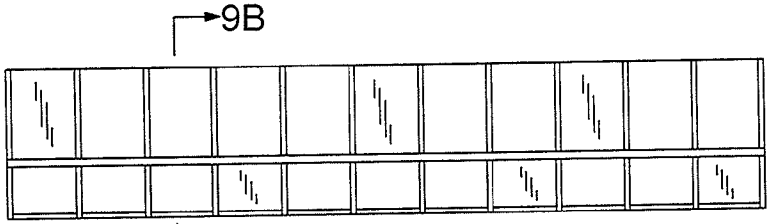
FIG. 9A is a top view of a container with the side walls partially folded.

As illustrated in FIGS. 3B, 9B and 10B, in at least one embodiment the folding of the container walls may be accomplished through a sliding hinge mechanism where the hinge pins 11 are affixed to the container walls 3 and slotted hinge plates 13 are affixed to the container base 1. FIG. 3B shows hinge pins 11 captured in the slots of the hinge plates 13. When the walls 3 are in the upright position as in FIG. 3B, the hinge pins are in the lower part of the slots in the hinges. As shown in FIG. 9B, the hinge pins 11 move upward in the hinge plates 13 to accommodate the upward movement of the walls as they begin to pivot. FIG. 10B shows the container with the walls fully folded and the hinge pins 11 in the final position of the hinge plate 13. If a liner is affixed to the container, this sliding action allows for the container to be folded without having to remove the liner. In another embodiment of the invention the hinge pins may be attached to the container base and the slotted hinge plate attached to the container walls. Those skilled in the art will recognize that other types of hinges may also be used to secure the walls to the base and allow their movement.

Figure 8A:
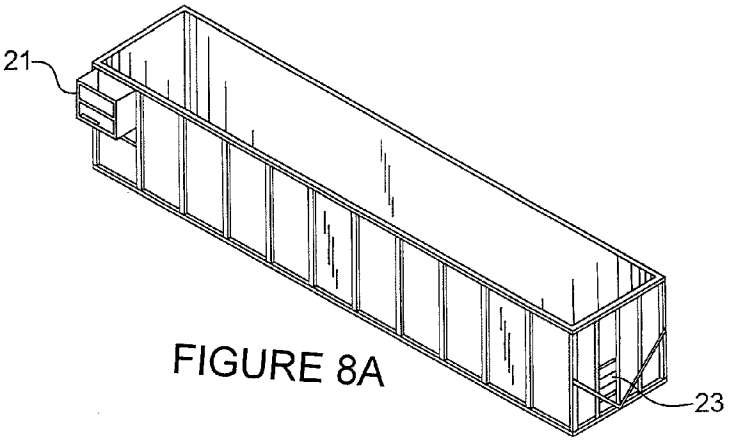
FIG. 8A is a top perspective view of the container illustrating an integral catwalk in an in use position.
Figure 8B:
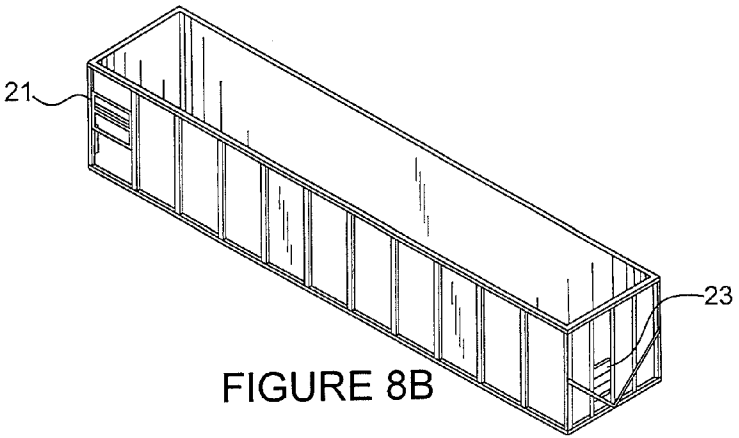
FIG. 8B is a top perspective view of the container illustrating the integral catwalk in a stored position.

The end walls of each container may have multiple functions. As shown in FIGS. 1A and 1B, the end walls may include sight windows 5 for visual inspection of the level of material in the container. These windows, which may be of any shape, can be made of glass, polymer, or another material sufficiently durable to withstand the pressure of a fully-filled container. One or both end walls may include through-the-wall piping with flanged connections. This allows drainage of a container and, if desired, connection of multiple containers. In closed containers the piping might be used to regulate pressure or circulating gases. FIGS. 8A and 8B show an example of a door 23 that may be included on one or both end walls to provide access to the interior of the container.

End walls may also be jointed and folded. Typically this is the case for end walls that do not include piping or other connections. End walls may also be configured to be removed. This allows flat storage of the end walls and the remainder of the container. Removal of the end walls also allows the end walls to be interchangeable, so that a specific connector or viewport may be used as necessary.

Figure 4:
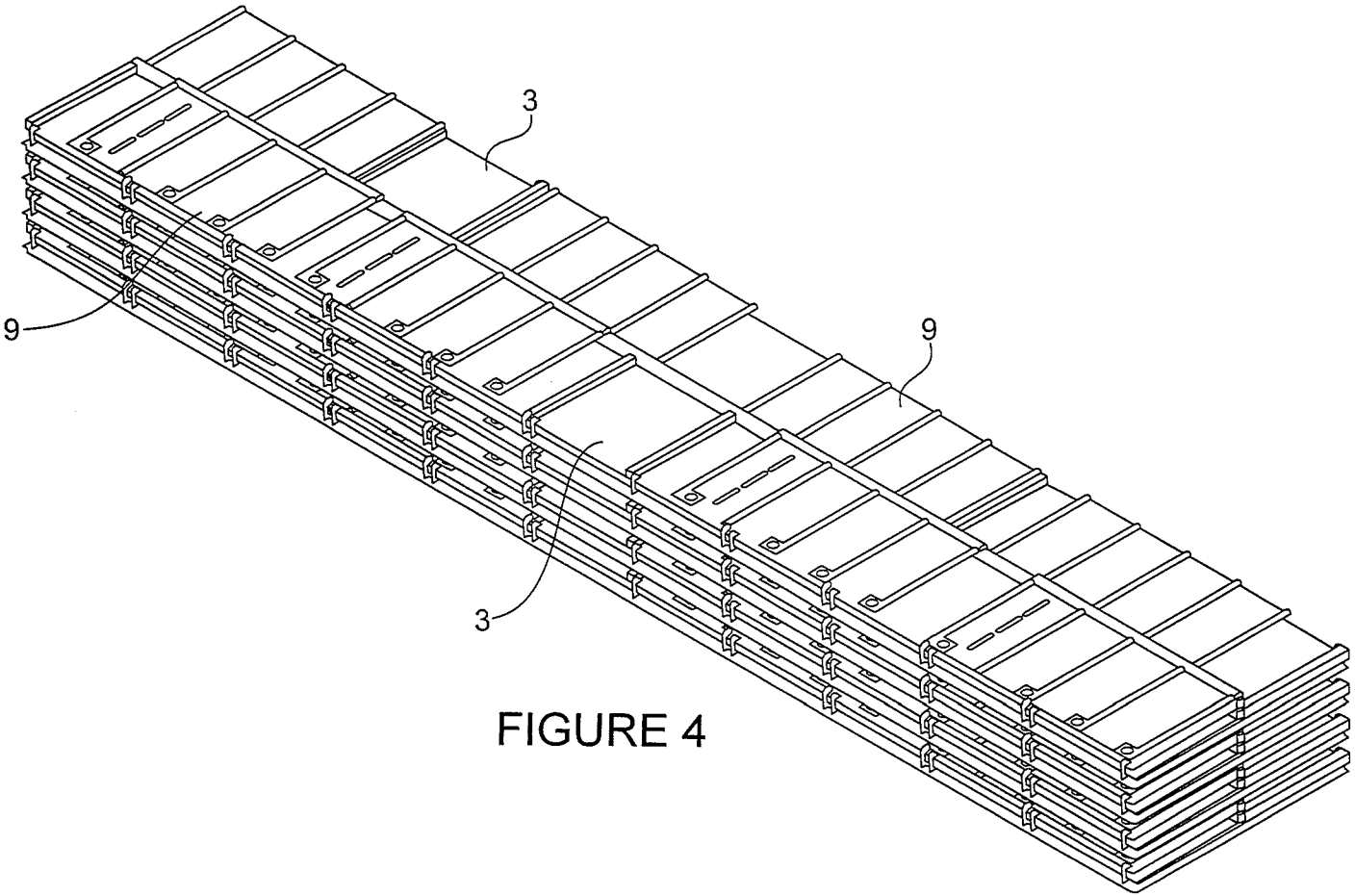
FIG. 4 shows a perspective view of multiple containers collapsed and folded for potential storage and transport.

FIG. 4 shows four containers that have been stacked for transportation. The end walls have been removed, the side walls folded onto the bottom, and the end walls laid flat against the side walls. Typically the containers are transported in their "disassembled" state, without transport of water, sand, or another material in any significant amount.

Figure 2:
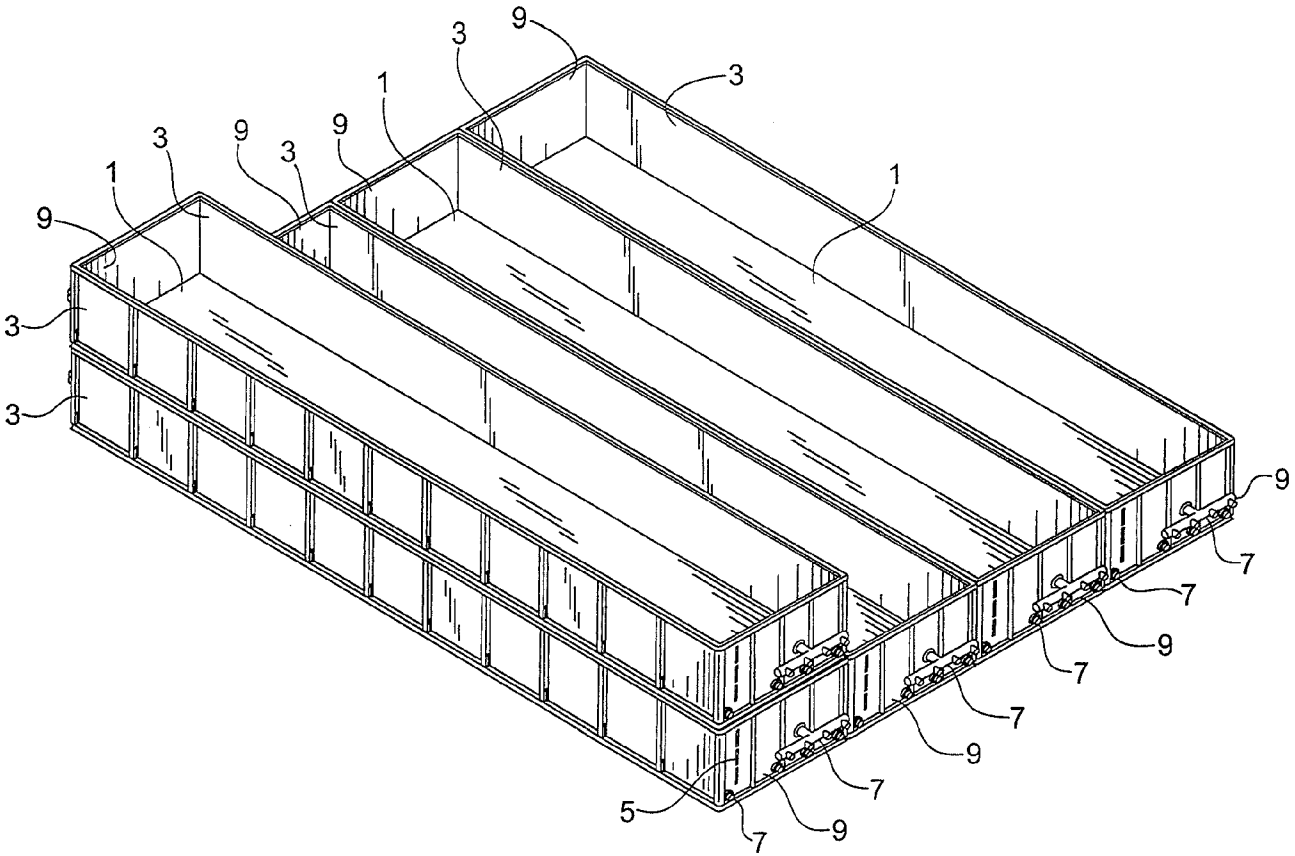
FIG. 2 shows various nonlimiting arrays of stacked, interlocking containers.

In a particularly preferred embodiment of the invention, a plurality of containers are combined into a single unit. This provides customized storage and drainage solutions. Various combinations of units are shown, for example, in FIGS. 2, 5, and 6. As shown in those Figures, the side walls, end walls, and bottom may interlock to provide a sturdy framework for stacking of the containers. This interlock may occur through, for example, a slot-and-groove arrangement. Once the containers are stacked they may be further affixed with clamps or other mechanisms, though that is not required.

Figure 5:
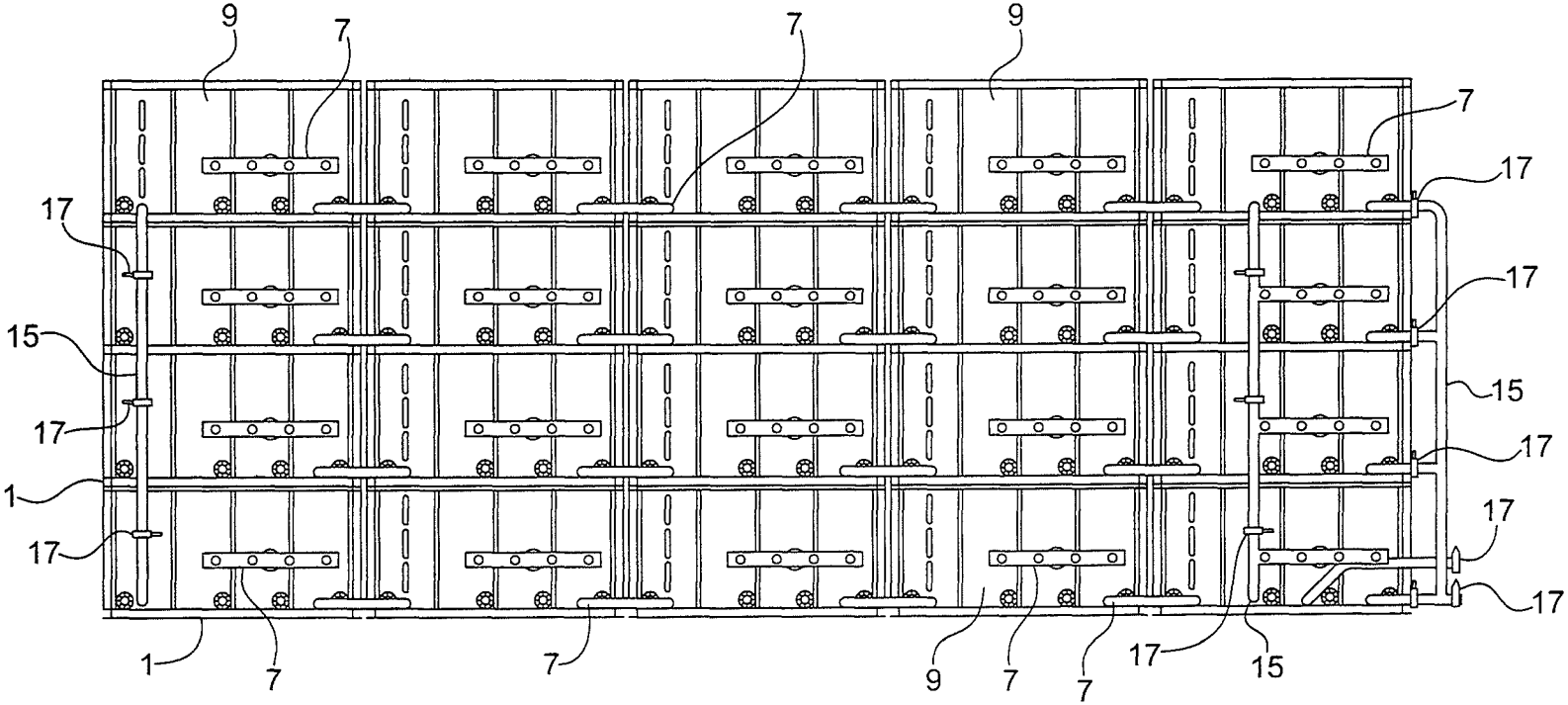
FIG. 5 shows a side view of a 4×5 container array.
Figure 6:
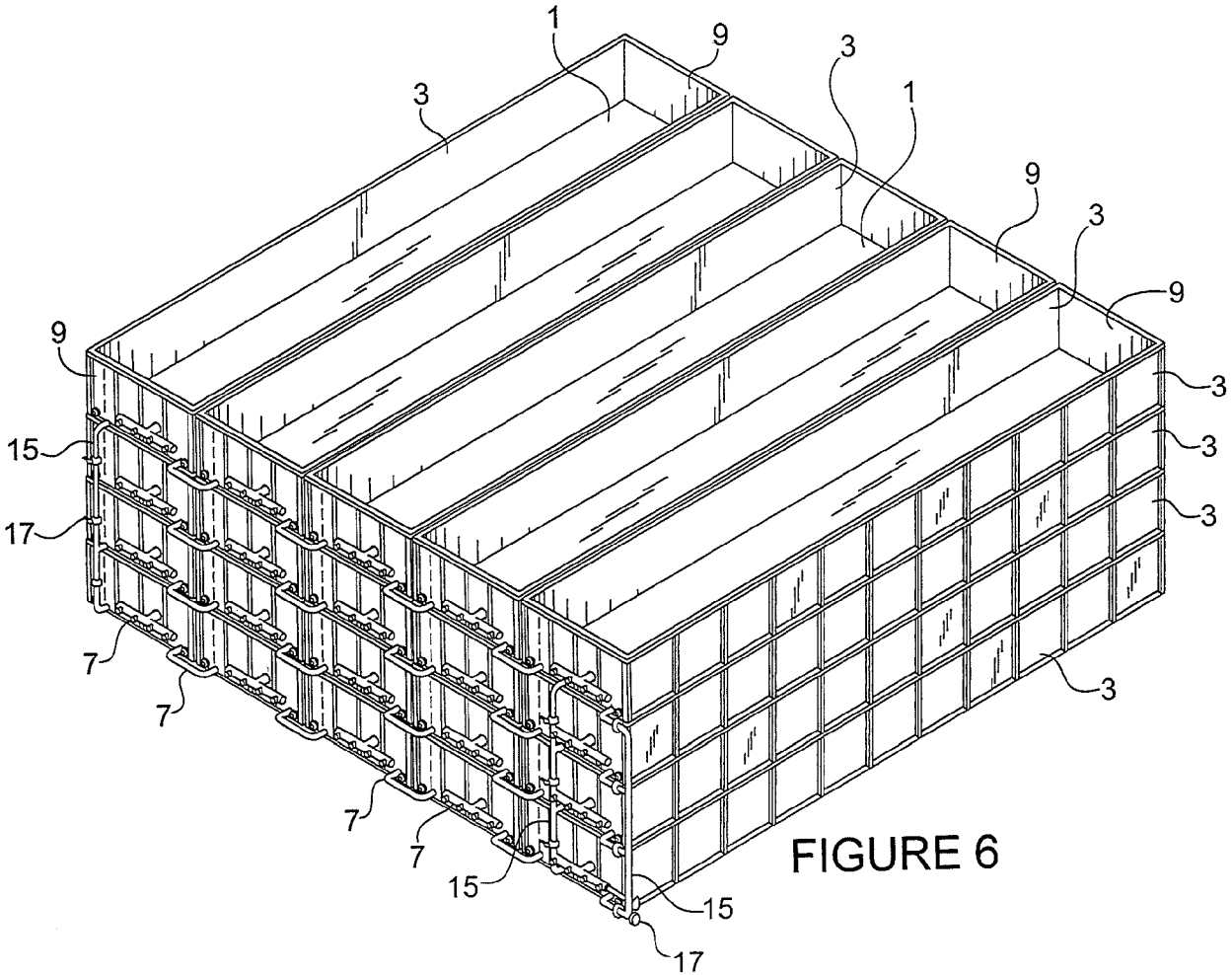
FIG. 6 shows a perspective view of a 4×5 container array.

As shown in the Figures, particularly FIG. 5, an assembled array of containers may include multiple layers of containers. These layers may be interconnected through multiple pipes that connect the containers of a layer to each other and to adjacent layers. Valving may be included to maintain water levels between layers and for isolating each layer during filling. Connectors may be included to allow water to be removed from each container, each layer, and/or the entire assembly. FIG. 5 also shows vertical piping 15 that places the containers in communication with each other when they are stacked. This piping 15 may be secured by clamps 17.

Typically in a container array the bottom containers are kept full by draining the upper containers into the bottom containers. Filling may be accomplished, for example, by pumping water or other material to be stored into each layer or container, or by filling the top layer and gravity-filling the lower layers.

As shown in FIGS. 8A and 8B, a folding catwalk 21 may be affixed to the container walls to provide a means of visually inspecting the contents of the container, and for filling, emptying, or cleaning the container through "over the wall" methods. The catwalk folds upon itself through a series of hinges and/or pins and is held in the use position with braces and supports. FIG. 8A shows the catwalk positioned for use, and FIG. 8B shows the catwalk in the stored position. When in the stored position, the catwalk will sit flush with the sides still allowing the containers to be folded flat and stacked for transportation. Multiple collapsible catwalks may be attached to a container to allow for access along the entire length and/or width of the container.

Figure 7A:
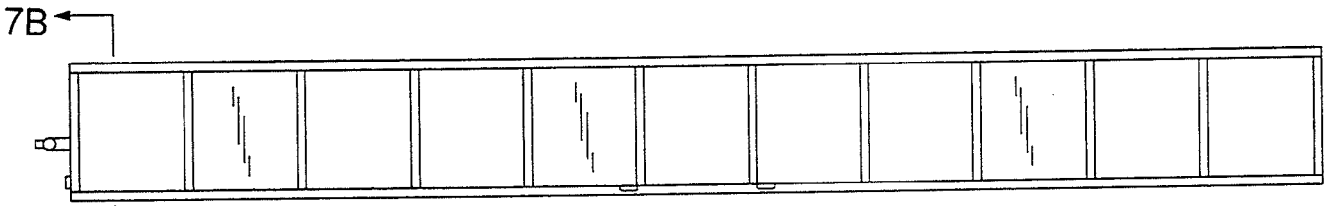
FIG. 7A is a top view of a container with the liner installed.
Figure 7C:
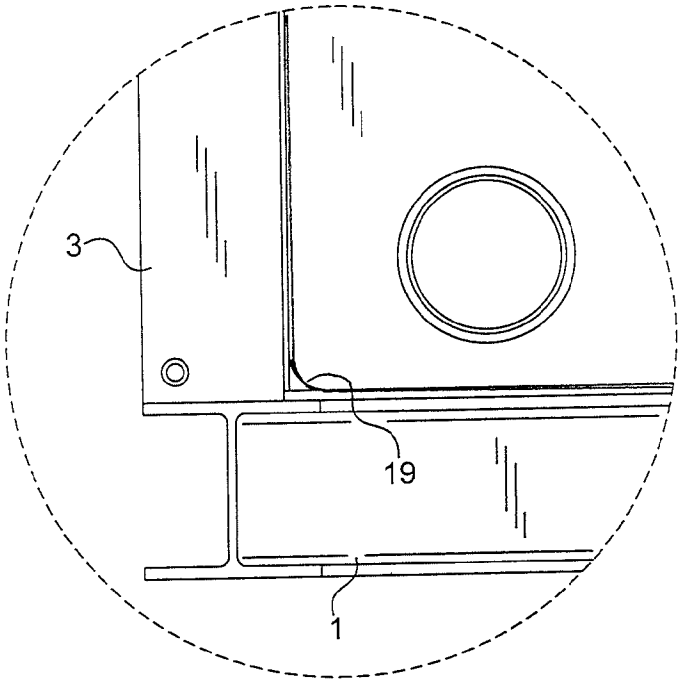
FIG. 7C is an enlarged view of the portion identified as 7C in FIG. 7B.
Figure 7B:
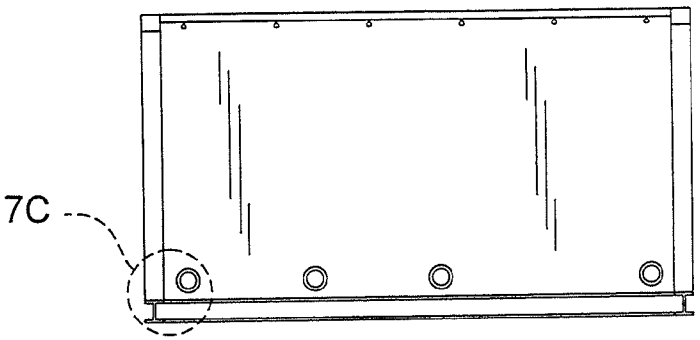
FIG. 7B is a cross-sectional view of the container taken along the section line 7B-7B in FIG. 7A.

Embodiments of the application may include a liner or liners. Each liner may be epoxy or it may be polypropylene or another polymer. Liners may be selected so that they are of complementary materials, or they may be independently selected. Polymer liners are typically "drop in" liners. These liners are usually temporary. Containers may include one or more anchor points or hooks designed to secure a liner or liners. As already noted, in some embodiments the liner, once placed, may be folded into the container and transported with the container as a single unit. Liners may be disposable or recyclable. One liner 19 is shown in FIG. 7C.

Although to this point this disclosure has focused on the physical structure and assembly of a container that may be used in one or more embodiments of the invention, the method for use of these and other containers that is provided herein is also of significant importance. Substantial benefit may be gained at water disposal and water treatment sites, as well as at sites that make use of such water (including but not limited to fracking sites), through use of a temporary water storage container that may be transported with other water storage containers on a flatbed truck or train car. Significant advantages may also be realized at facilities that have need for temporary storage of sand, gravel, cement, and the like. Moreover, it should be noted that although storage of water has been discussed in the context of hydraulic fracturing and other energy-producing processes, the containers may be equally effective when retaining clean water. This allows them to be brought in and quickly set up in an area that has a humanitarian or other emergency need for potable and/or nonpotable water.

Embodiments may include a method for providing temporary storage capacity at a location. In preferred embodiments this location is an energy extraction facility or a water purification facility. In a particularly preferred embodiment the location is a hydraulic fracturing drilling site. A plurality of storage containers are brought to the site in an unassembled state, then assembled on-site and used for storage, for example storage of water. "Assembly" should not be read to imply that the containers are in multiple pieces, though that is a possibility. The containers may be repeatedly filled and drained as necessary for proper function of the site. The collapsible nature of the containers lends them to easy assembly; rather than requiring a team of men to be dedicated to a project for many days, a container as described herein may be constructed by two or three men, with proper equipment, in the space of a day or less.

At completion of the use of the site, or at least at the point that use of the containers for water storage is no longer necessary, the containers may be disassembled. The disassembled containers may then be placed into onsite storage, where a plurality of containers may be stored where previously only a single assembled container might be located. The disassembled containers might also be removed, for example by truck, barge, or rail. Advantageously many containers may be removed by a single transport unit; for example, a single transport unit may be one truck, one barge or other vessel, or one rail car. The containers may be removed many at a time, increasing the efficiency of the removal. Upon removal the containers may be refurbished, re-lined, or, at the option of the user, immediately taken to a new site for use.

This method may be practiced, for example, with the collapsible storage containers reported herein. In a further embodiment a liner or liners may be included in the container to prevent or hinder movement of materials from the container into the surrounding environment. These liners may be replaced periodically, potentially eliminating a need to replace an entire container.

This method provides multiple advantages. Disassembly and assembly of the containers provides substantial time to clean them and ensure their structural integrity. Unlike frac tanks, which may be subject to regulations similar or identical to those for motor vehicles, the movement and storage of collapsible containers will impose a low administrative burden. Installation and maintenance of these collapsible, temporary containers will require less digging and grading than use of a pond. When the project (or the need for the substance being stored) concludes, all evidence of the presence of the temporary storage facility may also be removed. Although described in the context of water storage, methods as reported herein may also be used to store sand, gravel, and other materials that might normally require a tanker, pond, or truck. In some cases a container may store one material, then when that material is exhausted the container may be optionally lined or re-lined and used for a different material.

Containers may be different sizes. This provides an additional layer of flexibility not present with other storage methods, because temporary containers may be added or removed as the needs of a site change. If a nearby site has an immediate need for multiple storage units, a single truck, railcar, or other means of transportation may be used to quickly transport those multiple units. This avoids the need to requisition multiple trucks or railcars, each carrying or towing a single container.

Those of skill in the art will recognize that the various inventions and embodiments included herein may be combined in a number of beneficial conformations and combinations with a number of beneficial aspects. All of those conformations and combinations are part of the invention described herein.

We claim:

1. A method for creating a temporary water storage facility, the method comprising:

providing to a hydraulic fracturing drill site, through a single transport unit, a storage container, wherein said storage container is provided to the hydraulic fracturing drill site in a disassembled state that is unsuitable for storage of water;

placing said storage container into an assembled state;

inserting at least one liner into said storage container, wherein said storage container, after insertion of said at least one liner, is configured to store water;

introducing water into the storage container so that the water is held in the liner;

using the water in said storage container for hydrocarbon extraction that is being carried out at the hydraulic fracturing drill site; and disassembling said storage container when the use of the storage container at the hydraulic fracturing drill site is completed.

2. The method of claim 1, further comprising, following the disassembling of said storage container, transporting said storage container to either storage or a different hydraulic fracturing drill site.

3. The method of claim 2, wherein said single transport unit is a first single transport unit, and said transporting of said storage container to either storage or the different hydraulic fracturing drill site is accomplished using a second single transport unit.

4. The method of claim 1, further comprising, following the disassembling of said storage container, storing said storage container in a disassembled state.

5. The method of claim 1, wherein said single transport unit is a truck.

6. A method for creating a temporary water storage facility at a hydraulic fracturing drill site, the method comprising:

providing storage containers to the hydraulic fracturing drill site through a single transport unit, the storage containers provided at the hydraulic fracturing drill site each comprising a pair of side walls that are foldable relative and a pair of end walls, the storage containers being transported to the hydraulic fracturing drill site while the storage containers are in a disassembled state in which the side walls are folded;

assembling each of the plurality of storage containers at the hydraulic fracturing drill site to produce a plurality of assembled storage containers which each include the side walls in an upstanding position and at opposite sides, and the end walls in an upstanding position at opposite ends;

inserting at least one liner into each of the plurality of assembled storage containers at the hydraulic fracturing drill site;

introducing water into the plurality of assembled storage containers so that the water is held in the liner;

using the water in the plurality of assembled storage containers as a part of a hydraulic fracturing process at the hydraulic fracturing drill site; and disassembling the plurality of assembled storage containers when use of the plurality of assembled storage containers is completed.

7. The method of claim 6, further comprising, following the disassembling of said plurality of assembled storage containers, transporting said storage containers to either storage or a different hydraulic fracturing drill site.

8. The method of claim 7, wherein said single transport unit is a first single transport unit, and said transporting of said storage containers to either storage or the different hydraulic fracturing drill site is accomplished using a second single transport unit.

9. The method of claim 6, further comprising, following the disassembling of said storage containers, storing said storage containers in a disassembled state.

10. The method of claim 6, wherein said single transport unit is a truck.

11. The method of claim 6, further comprising placing said plurality of storage containers at the hydraulic fracturing drill site into communication with each other using at least one tube.

12. A method comprising:

assembling a disassembled storage container at a hydraulic fracturing drill site, the disassembled storage container including side walls and end walls;

the disassembled storage container being assembled at the hydraulic fracturing drill site to produce an assembled storage container in which the side walls are upright and are positioned along opposite sides and in which the end walls are upright and are positioned along opposite ends;

introducing water into the assembled storage container so that the water is held in the assembled storage container;

using the water in the assembled storage container in a hydrocarbon extraction operation that is being carried out at the hydraulic fracturing drill site; and disassembling the assembled storage container when use of the storage container in the hydrocarbon extraction operation is completed.

13. The method of claim 12, further comprising, following the disassembling of said assembled storage container, transporting said storage container to either storage or a different hydraulic fracturing drill site.

14. The method of claim 12, further comprising, following the disassembling of said assembled storage container, storing said storage container in a disassembled state.

* * * * *